US007787812B2

(12) United States Patent
Wayman

(10) Patent No.: US 7,787,812 B2
(45) Date of Patent: Aug. 31, 2010

(54) TRANSFER DI-CHOROTRON (DICOR) COVER WITH CONSTANT PAPER CURRENT DENSITY

(75) Inventor: William H. Wayman, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 1172 days.

(21) Appl. No.: 11/386,014

(22) Filed: Mar. 17, 2006

(65) Prior Publication Data

US 2007/0217833 A1 Sep. 20, 2007

(51) Int. Cl.
*G03G 15/16* (2006.01)

(52) U.S. Cl. ..... 399/311

(58) Field of Classification Search ..... 399/311, 399/312

See application file for complete search history.

(56) References Cited

U.S. PATENT DOCUMENTS 4,423,134 A * 12/1983 Miyakawa et al. ..... 399/245 X
4,469,428 A * 9/1984 Yoshioka et al. ..... 399/169
4,603,964 A * 8/1986 Swistak ..... 399/169
2006/0280531 A1* 12/2006 Washington et al. ..... 399/311

FOREIGN PATENT DOCUMENTS

JP 04298768 A * 10/1992

* cited by examiner

*Primary Examiner*—David M Gray
*Assistant Examiner*—Erika Villaluna
(74) *Attorney, Agent, or Firm*—Fay Sharpe LLP

(57) ABSTRACT

A sliding cover of a Di-chorotron includes an electrode connected to an external circuit that simulates the impedance of media on a photoreceptor to maintain constant current density through media on the photoreceptor while blocking transfer current from passing to uncovered portions of the photoreceptor, thus reducing or eliminating paper edge ghosting effects in a xerographic machine's output.

20 Claims, 4 Drawing Sheets

TRANSFER DI-CHOROTRON (DICOR) COVER WITH CONSTANT PAPER CURRENT DENSITY

BACKGROUND AND SUMMARY

Some prior art xerographic devices use an adjustable cover on a transfer Di-chorotron, or "Dicor," to eliminate paper edge ghost (PEG) defects in output. PEG defects are observed as a difference in halftone densities after a change in media size, resulting from trapped positive charge in directly exposed areas of the photoreceptor. For example, such ghosts can be caused through use of the same size of paper for a given number of cycles, then switching to a different size of paper that at least partially exposes the portions of the photoreceptor that are not as fatigued from use. The newly exposed portions of the photoreceptor thus respond to the xerographic process differently, producing a paper edge ghost.

The cover blocks the transfer current to the photoreceptor outside the paper width area. The transfer power supply works to control a constant transfer current. Unfortunately, as the cover closes off a portion of the Dicor, the current density supplied to the paper area increases, which can cause variations in output quality. To maintain a constant transfer current, the operator must make adjustments to the transfer current settings every time paper width changes, which is cumbersome. Additionally, the use of an inboard transfer cover as currently configured, while effective, is tedious from the customer perspective, requiring removal of the transfer device, repositioning the cover and manually resetting the transfer current by entering the media type and paper width, a further complication that will grow as the media list expands over time.

A proposed solution to eliminate operator adjustment of the transfer current settings is to incorporate these settings into the media library stored within the xerographic machine. In this manner, the xerographic machine's controller would look up the proper transfer current settings for a given type/size of media. However, this would require many more entries for all the combinations of media type and width customers might employ. Customers have complained because of the complexity and tediousness of current operation, and making such operation more complex is likely to be further dissatisfying to customers.

Embodiments modify the sliding transfer Dicor cover by adding a conductive electrode and connecting the electrode to a grounded external impedance that simulates a photoreceptor impedance. With such modifications, the current density captured by the electroded sliding transfer Dicor cover is the same as in the media area. This maintains a constant media current density as the cover occludes different widths of the Dicor. The external equivalent circuit simulates the impedance of paper on photoreceptor making the portion of the photoreceptor that has no media, yet faces the covered Dicor, "look more like" the paper covered area. This enables constant transfer current to the media independent of the extent of coverage of the wire by the sliding electroded transfer cover. As a result, the sliding cover can be moved anywhere within the required range without resetting the power supply transfer current. Embodiments thus eliminate the need for having an operator change transfer current settings whenever media width changes. Embodiments provide for different combinations of conductive electrode geometry on the sliding cover and/or the impedance of a passive external grounded circuit to create the impedance required to simulate a photoreceptor in the covered area.

Mechanical constraints prohibit a simple grounded electrode from being at or very near the photoreceptor surface. Because the inside of the cover is closer to the Dicor wire than the photoreceptor surface, electric fields are higher and arcing might occur. Embodiments can employ an AC and/or DC voltage bias on the electrode to reduce or eliminate arcing. Any grounded external impedance connected to the electrode will result in a passive AC and/or DC electrode voltage bias generated by the voltage drop in the external impedance from the electrode current. The passive impedance of embodiments can be as simple as a resistor or can include back-to-back Zener diodes and a series resistor. This impedance, and in the case of embodiments with Zener diodes the impedance is non-linear, will allow the electrode to partially follow the high voltage wire AC and to reduce the risk of arcing from the high voltage wire to the shield electrode. The current collected on the shield electrode is measured by the power supply as a transfer current since it is ultimately passed to ground, allowing the paper current density to remain constant as the sliding cover changes position.

DESCRIPTION

Figure 1:
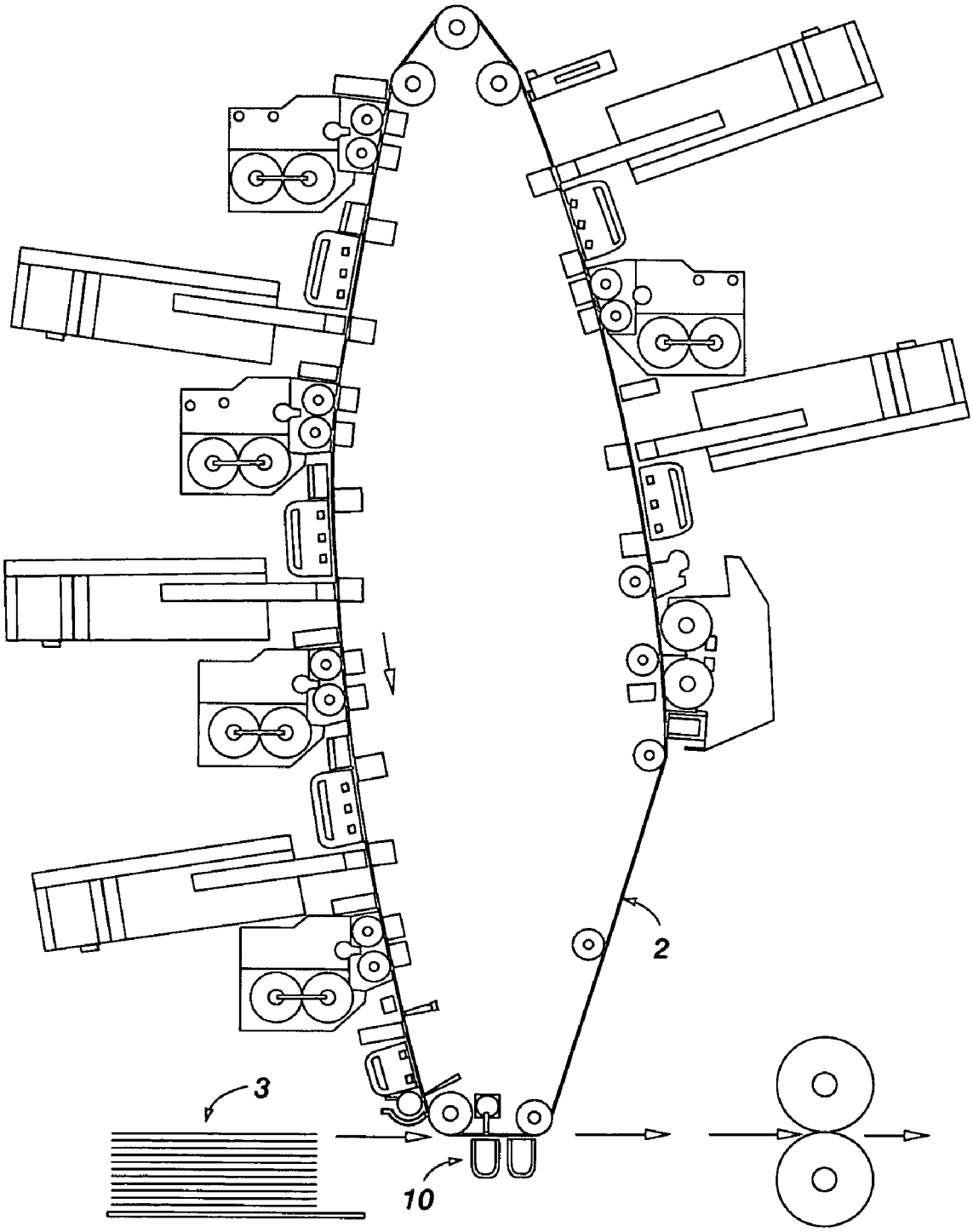
FIG. 1 shows a xerographic engine in which embodiments can be employed.
Figure 2:
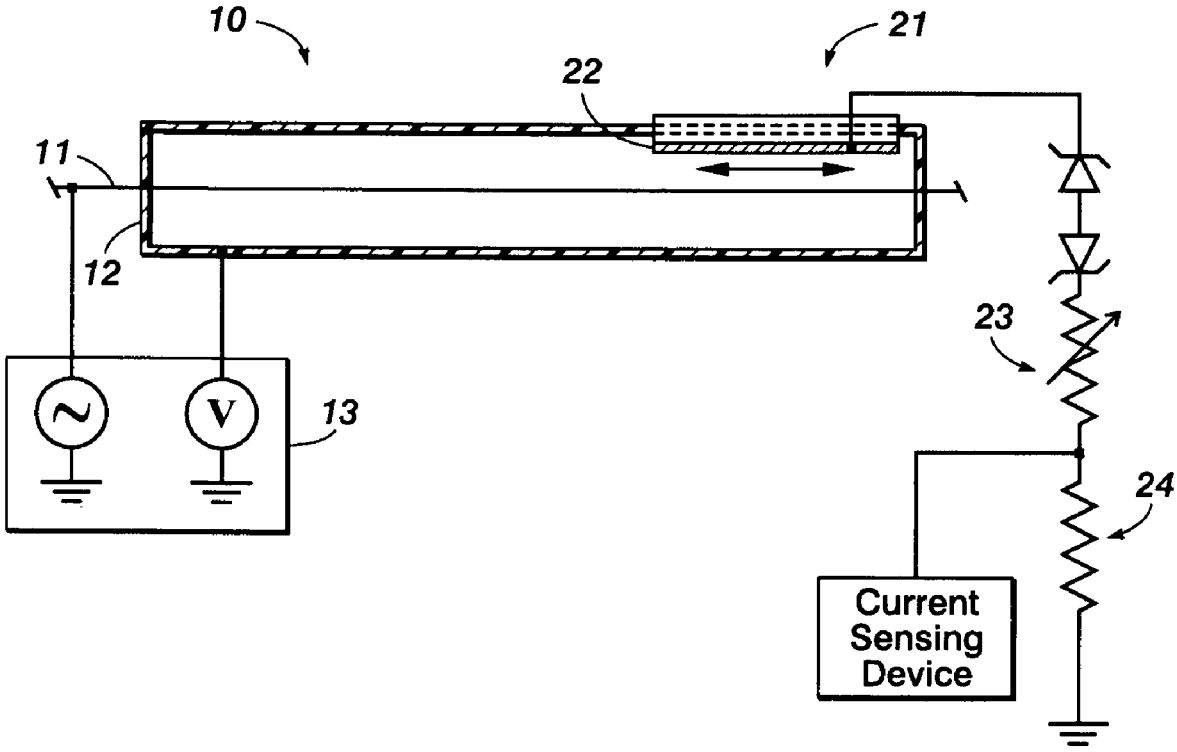
FIG. 2 shows a schematic diagram of embodiments.

As seen, for example, in the accompanying FIGS. 1-5, embodiments include a Dicor assembly 10 including a high voltage wire 11 extending along its length within a shield 12. When the Dicor assembly 10 is installed in a xerographic machine 1, the shield 12 is open toward the photoreceptor 2 so that the Dicor assembly 10 can create a transfer current to the photoreceptor 2 as required for the xerographic process carried out by the machine. The Dicor assembly is connected to a power supply 13 that is controlled by a controller 14 to ensure proper transfer current is applied when media 3 is present on the photoreceptor 2.

Embodiments provide a sliding cover 21 that can be made of an insulating material, such as plastic, that is mounted across the open side of the shield 12. A conductive electrode 22 is applied to the inside of the cover in embodiments. The electrode 22 can be made, for example, from metal foil tape, such as copper foil tape, and is of a width that provides an exposed conductive cross section to collect corona current. While embodiments employ an electrode of, for example, 4 mm width, the electrode of embodiments can have a width in the range of from about 1 mm to about 10 mm as appropriate for the environment in which it is to operate. The electrode 22 of embodiments is connected to a variable resistance 23 and to a resistor 24 of known resistance to enable measurement of current flowing through the circuit. In embodiments, the resistor 24 has a value of 100K Ohm, which can provide 10 μA/V sensitivity.

Figure 3:
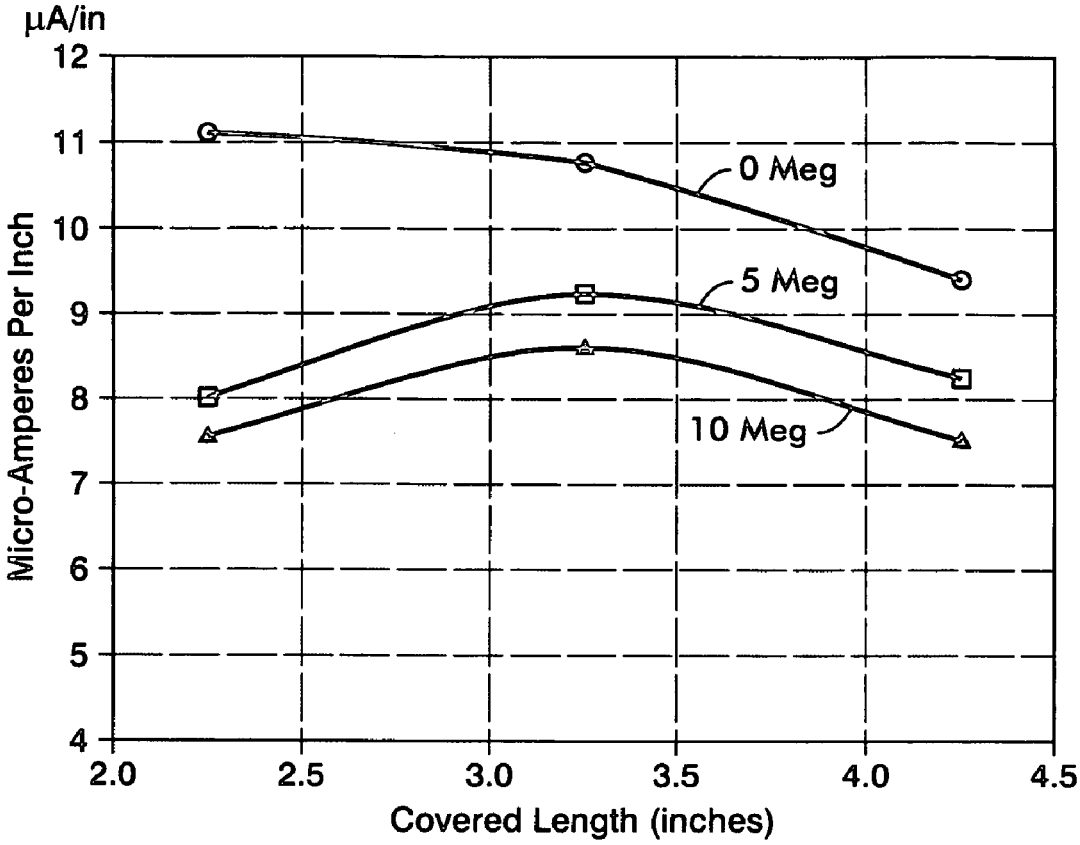
FIG. 3 shows a graph of transfer current density vs. covered length using embodiments.
Figure 4:
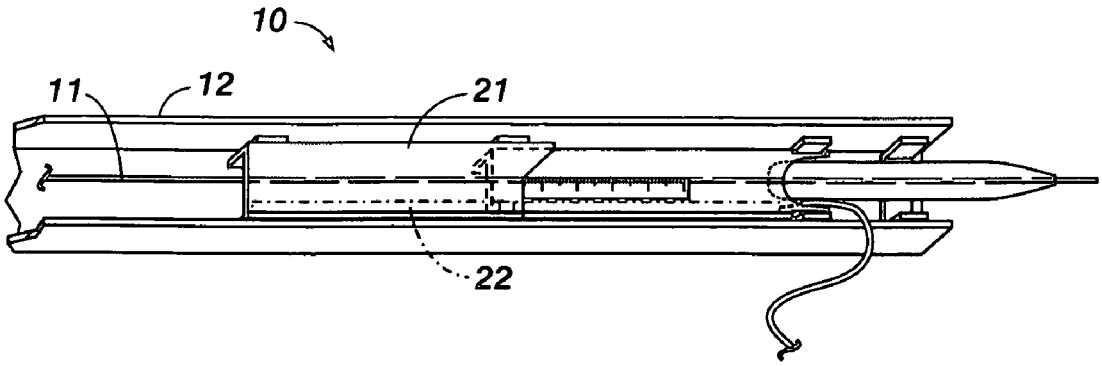
FIG. 4 is an elevation of a cover installed on a Dicor according to embodiments.
Figure 5:
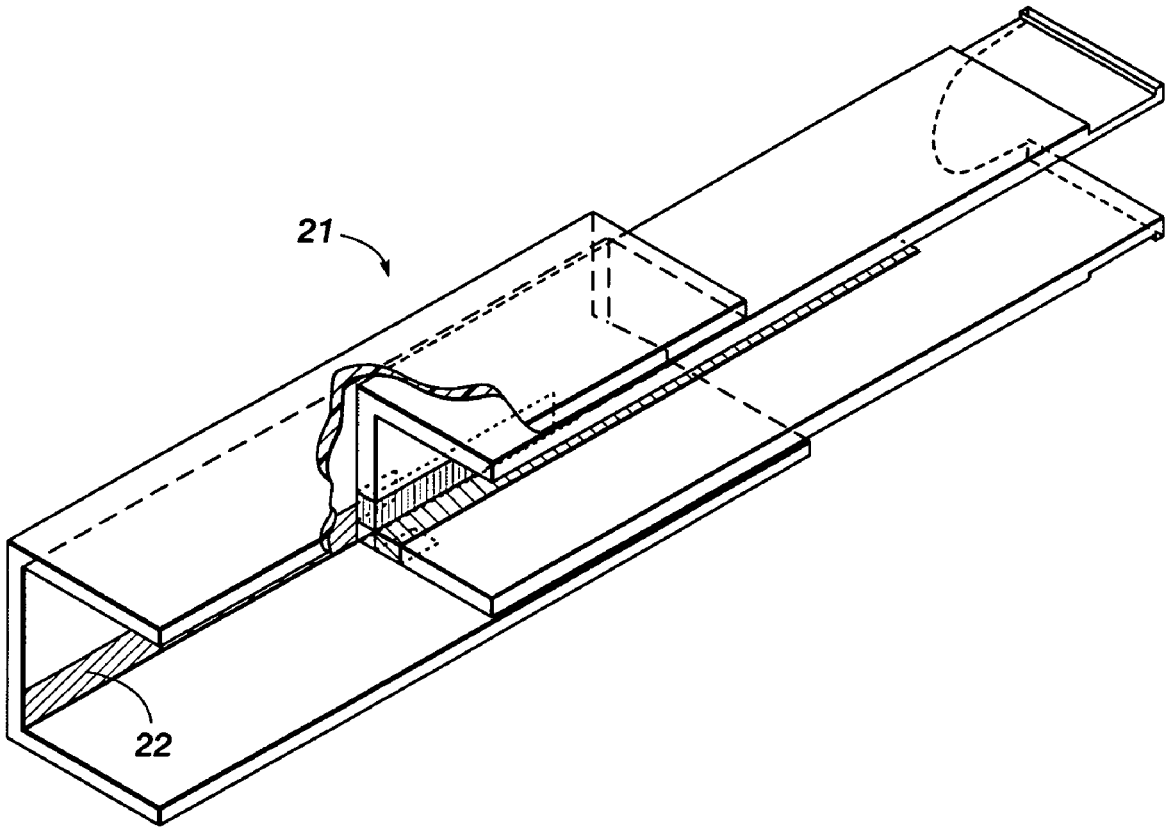
FIG. 5 is an elevation of a cover according to embodiments adjacent a Dicor with which it can be used.

In an exemplary embodiment, the high voltage charging wire 11 of transfer Dicor assembly 10 will typically have a 16" corona charging length. With such a Dicor 10, a total transfer current of 120 μA will result in a current density of 7.5 μA/in. The graph shown in FIG. 3 shows the current density in μA/in of the electroded cover vs. series resistance in the external circuit. While an optimum resistance is not necessarily shown or known, testing different cover positions and resistances determined that a preferred resistance should be higher than 10M ohms in order to achieve 7.5 μA/in. for particular arrangements.

It will be appreciated that various of the above-disclosed and other features and functions, or alternatives thereof, may be desirably combined into many other different systems or applications. It will also be noted that various presently unforeseen or unanticipated alternatives, modifications, variations or improvements may be subsequently made by those skilled in the art which are also intended to be encompassed by the following claims.

What is claimed is:

1. In a Di-chorotron charging device comprising a shield with an open side and a wire arranged longitudinally within the shield, the wire being connected to a power supply controlled by a controller to provide a desired photoreceptor transfer current, a Di-chorotron current density control cover comprising:

an insulating cover slidably mounted on a shield of a Di-chorotron, said cover being slidable over varying areas of the wire;

an electrode mounted on an internal surface of the cover; and an external circuit connecting the electrode to a ground, wherein said circuit includes a variable resistor and a fixed resistor for creating an impedance in the covered area that simulates a photoreceptor.

2. The control cover of claim 1 wherein the value of the fixed resistance is selected and the electrode width sized to draw a current substantially equivalent to what a photoreceptor would draw from the portion of the Di-chorotron covered by the electroded cover.

3. The control cover of claim 1 wherein the resistance is part of an external circuit that further comprises at least one Zener diode.

4. The control cover of claim 3 wherein the external circuit comprises two Zener diodes arranged back to back in series between the electrode and the ground.

5. The control cover of claim 1 wherein the cover is sized to occlude a portion of an open portion of the shield such that the unblocked portion of the shield is the same width as media between the Di-chorotron and a photoreceptor.

6. The control apparatus of claim 1, wherein the fixed resistor has a value of 100K Ohm and provides 10 μA/V sensitivity.

7. In a xerographic machine including a photoreceptor and a Di-chorotron connected to a power supply of the xerographic machine and arranged to effect transfer of a toner image from the photoreceptor to media on the photoreceptor, the Di-chorotron including a shield, a high voltage wire, a current density control method of the Di-chorotron comprising:

delivering a substantially constant current to the Di-chorotron;

providing a sliding cover of insulative material sized to block the current transfer between the Di-chorotron and a portion of the photoreceptor not covered by media; and drawing the blocked current through an alternate circuit, comprising a fixed resistor and a variable resistor between the electrode and the ground for creating impedance in the area covered by said cover, thereby simulating even current transfer across the entire Di-chorotron and preserving a desired current density across the media on the photoreceptor.

8. The method of claim 7 wherein blocking comprises:

positioning the cover over the portion of the photoreceptor not covered by media.

9. The method of claim 8 wherein drawing comprises:

mounting an electrode on the sliding cover;

providing an impedance between the electrode and ground; and connecting the electrode to ground via the impedance.

10. The method of claim 9 wherein providing an impedance comprises providing at least one Zener diode.

11. A xerographic machine photoreceptor paper edge ghosting control apparatus comprising:

an insulative cover slidably mounted on a shield of a Di-chorotron, the Di-chorotron including a charging wire and the shield being oriented so that the charging wire can transfer current to the photoreceptor, the insulative cover being arranged so that a portion of a charging wire of the Di-chorotron is blocked from transferring current to the photoreceptor by the insulative cover, the apparatus further comprising an external circuit configured to simulate the presence of media on the blocked portion of the photoreceptor, thereby maintaining current density at a substantially constant level and substantially eliminating paper edge ghosting, wherein the external circuit is connected to said Di-chorotron by an electrode attached to said cover and includes a fixed resistance wherein the value of the fixed resistance is selected and the electrode width sized to draw a current substantially equivalent to what a photoreceptor would draw from the portion of the Di-chorotron covered by the electroded cover.

12. The control apparatus of claim 11 wherein the sliding cover carries an electrode on a surface facing the charging wire and connected to the external circuit.

13. The control apparatus of claim 12 wherein the electrode is conductive foil.

14. The control apparatus of claim 13 wherein the conductive foil is copper and is from about 1 mm wide to about 10 mm wide.

15. The control apparatus of claim 11 wherein the external circuit comprises at least one resistor connected to ground.

16. The control apparatus of claim 11 wherein the external circuit comprises at least one Zener diode.

17. The control apparatus of claim 16 wherein the at least one Zener diode is connected in series with a resistor that is connected to ground.

18. The control apparatus of claim 17 further comprising an electrode on an inner surface of the sliding cover and connected to the at least one Zener diode.

19. The control apparatus of claim 11, wherein the external circuit includes a variable resistor and a fixed resistor to enable measurement of current flowing through the circuit.

20. The control cover of claim 11, wherein the fixed resistor has a value of 100K Ohm and provides 10 μA/V sensitivity.

* * * * *